US009752524B2

(12) United States Patent
Hagner et al.

(10) Patent No.: US 9,752,524 B2
(45) Date of Patent: Sep. 5, 2017

(54) ADAPTIVE CAM ANGLE ERROR ESTIMATION

(71) Applicant: Ford Global Technologies, LLC, Dearborn, MA (US)

(72) Inventors: David G. Hagner, Beverly Hills, MI (US); Mrdjan J. Jankovic, Birmingham, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 166 days.

(21) Appl. No.: 14/315,225

(22) Filed: Jun. 25, 2014

(65) Prior Publication Data

US 2015/0377165 A1 Dec. 31, 2015

(51) Int. Cl.
*F02D 41/14* (2006.01)
*F02D 41/00* (2006.01)
*F02D 41/24* (2006.01)

(52) U.S. Cl.
CPC ..... *F02D 41/1497* (2013.01); *F02D 41/009* (2013.01); *F02D 41/0025* (2013.01); *F02D 41/2454* (2013.01); *F02D 41/2461* (2013.01); *F02D 2041/001* (2013.01); *F02D 2200/0402* (2013.01); *F02D 2200/0411* (2013.01)

(58) Field of Classification Search
CPC ..... Y02T 10/18; Y02T 10/42; F02D 13/0261; F02D 2041/001; F02D 2250/18; F02D 41/0002; F02D 13/0207; F02D 13/0219; F02D 13/0234
See application file for complete search history.

(56) References Cited

U.S. PATENT DOCUMENTS 5,357,932 A * 10/1994 Clinton ..... F02D 13/0219 123/478
5,635,634 A 6/1997 Reuschenbach et al.
6,626,147 B2 9/2003 Russell et al.
6,766,775 B2 7/2004 Riedle et al.
7,328,673 B2 2/2008 Kawamura
8,613,263 B2 12/2013 Leone et al.
2004/0206317 A1* 10/2004 Song ..... F02D 13/0207 123/90.11
2005/0188929 A1* 9/2005 Kawamura ..... F02D 13/02 123/90.15
2006/0219197 A1* 10/2006 Machida ..... F01L 1/34403 123/90.16
2008/0091332 A1* 4/2008 Yasui ..... F02D 41/0002 701/102
2008/0097683 A1* 4/2008 Yasui ..... F02D 13/0207 701/104
2013/0261935 A1 10/2013 Jankovic

* cited by examiner

*Primary Examiner* — Sizo Vilakazi
(74) *Attorney, Agent, or Firm* — Julia Voutyras; McCoy Russell LLP

(57) ABSTRACT

Methods and systems for correcting cam angle measurements for engine-to-engine build variation are disclosed. In one example, a method comprises learning cam angle corrections to update a measured cam angle responsive to air-fuel ratio errors during selected conditions, and learning air and fueling errors responsive to the air-fuel ratio error otherwise. In this way, cam angle errors due to engine build variation may be corrected, thereby improving other air and fuel adaptation methods and improving engine emissions.

20 Claims, 7 Drawing Sheets

ADAPTIVE CAM ANGLE ERROR ESTIMATION

FIELD OF THE INVENTION

The present application relates generally to the control of a vehicle, and particularly to systems and methods for estimating cam timing errors.

BACKGROUND AND SUMMARY

Changes in variable cam timing (VCT) affect engine volumetric efficiency. Typical engine control methods use volumetric efficiency characterization, calibrated off-line at specific engine conditions, to perform on-line computations for functions that require such information. For example, in some control methods, volumetric efficiency information and intake manifold pressure measurements are used to compute engine air flow. Further, some control methods use volumetric efficiency to compute estimated intake manifold pressure from engine air flow values.

However, errors in cam angle measurement due to engine build variation or other sources can introduce errors in the estimated volumetric efficiency, and these errors propagate through air flow and intake manifold pressure estimations. Moreover, aggressive use of VCT systems for either late exhaust valve opening or late intake valve closing (LIVC or Miller-cycle in boosted engines) makes volumetric efficiency very sensitive to engine build variation.

A common method to correct for some engine build variation in cam timing is to ensure that the measured cam angle relative to some physical end-of-travel position is zero when the cam is assumed to be in that position, for example, the unpowered, default position. Such a method corrects for some sources of engine build variation, but not all. For example, misalignment of the physical end-of-travel position with respect to physical valve opening or closing events is not corrected.

The inventors herein have identified the above issues and devised several approaches to address it. In particular, methods and systems for correcting cam angle measurements for engine-to-engine build variation are disclosed. In one example, a method comprises learning cam angle corrections to update a measured cam angle responsive to air-fuel ratio errors during selected conditions, and learning air and fueling errors responsive to the air-fuel ratio error otherwise. In this way, cam angle errors due to engine build variation may be corrected, thereby improving other air and fuel adaptation methods and improving engine emissions.

In another example, a method comprises generating a first air-fuel ratio estimate based on engine operating conditions, generating a second air-fuel ratio estimate based on modified engine operating conditions, generating a first error based on the first air-fuel ratio estimate and a measured air-fuel ratio, generating a second error based on the second air-fuel ratio estimate and the first air-fuel ratio estimate, generating a cam angle correction based on the first error and the second error, and updating a cam angle measurement based on the cam angle correction. In this way, off-line volumetric efficiency characterization information may be utilized to isolate a cam timing contribution to air-fuel ratio errors.

In another example, a system for controlling an engine comprises a controller configured with instructions stored in non-transitory memory, that when executed, cause the controller to learn cam angle corrections responsive to air-fuel ratio errors during selected conditions. In this way, a vehicle engine can eliminate variable cam timing calibration errors specific to the engine.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTIONS OF THE DRAWINGS

DETAILED DESCRIPTION

Figure 5:
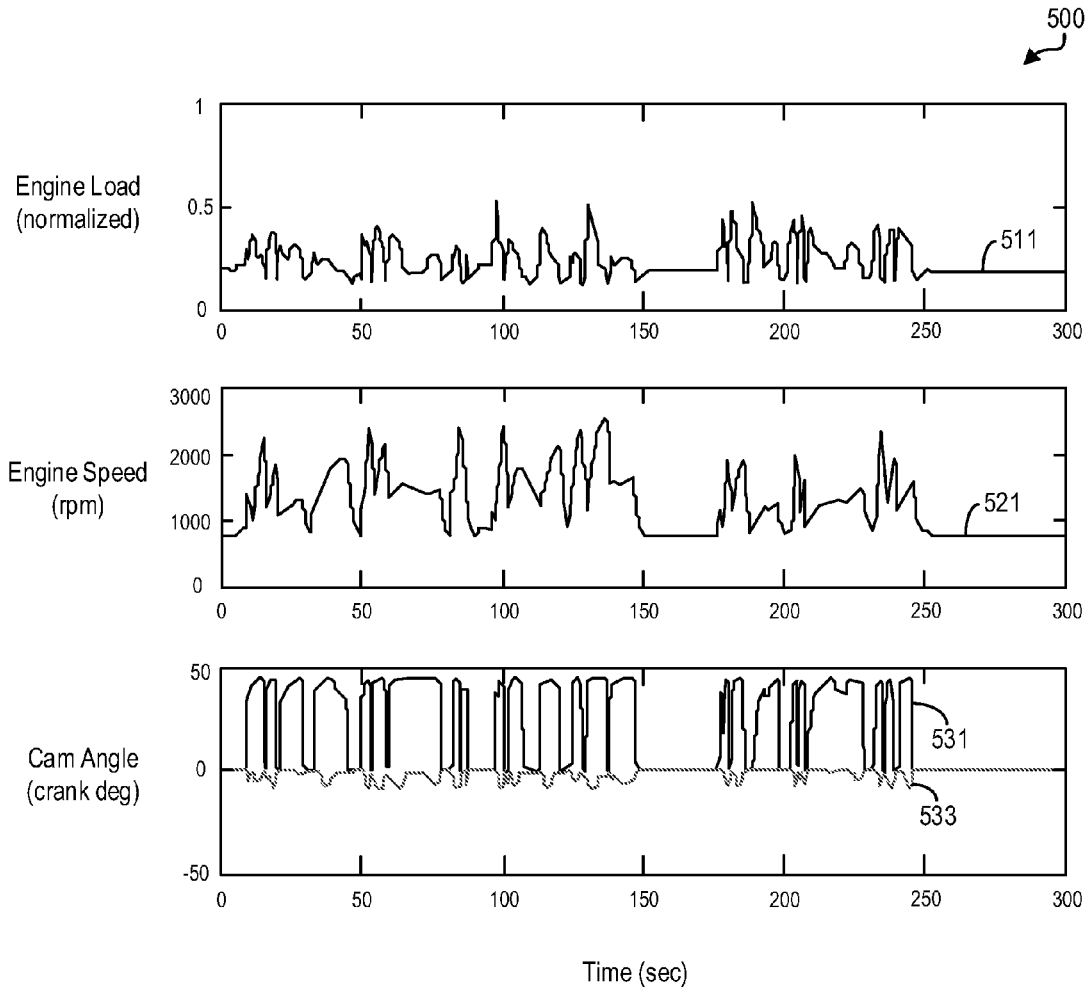
FIG. 5 shows a set of graphs illustrating example vehicle data.
Figure 6:
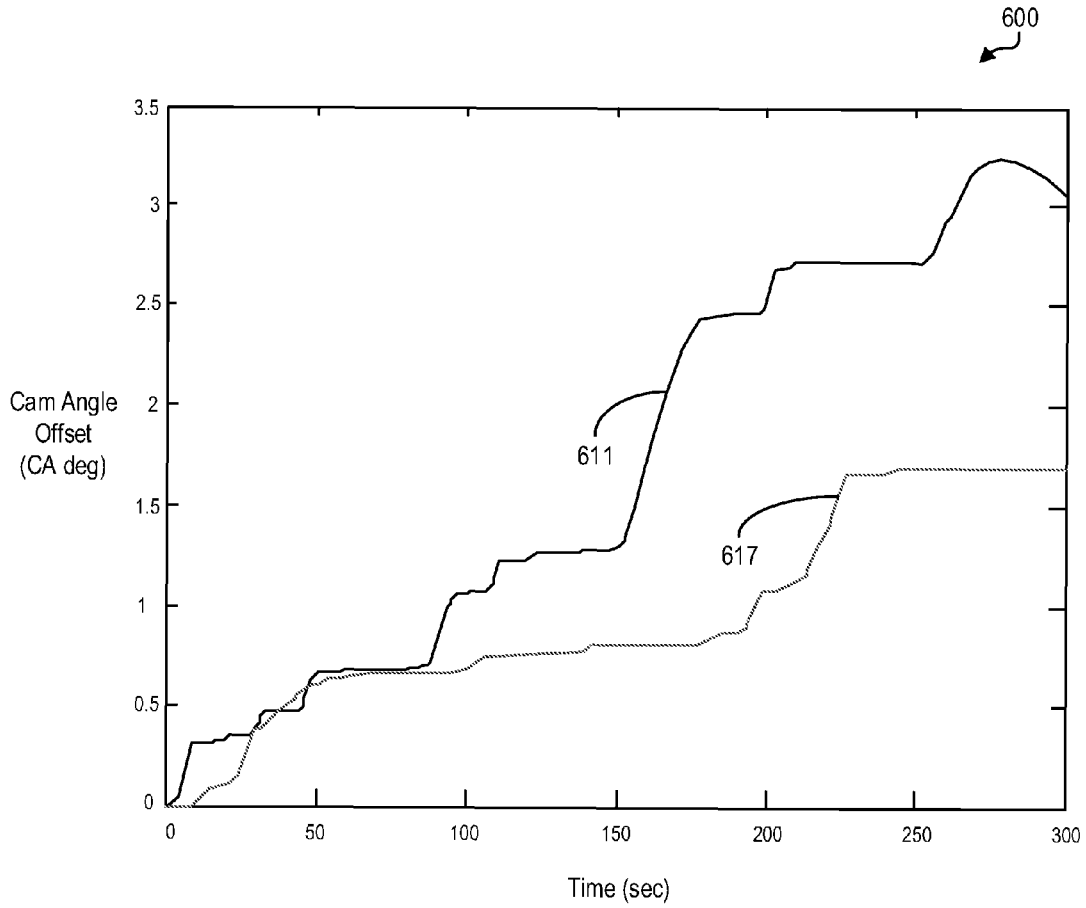
FIG. 6 shows example engine performance based on example vehicle data.
Figure 7:
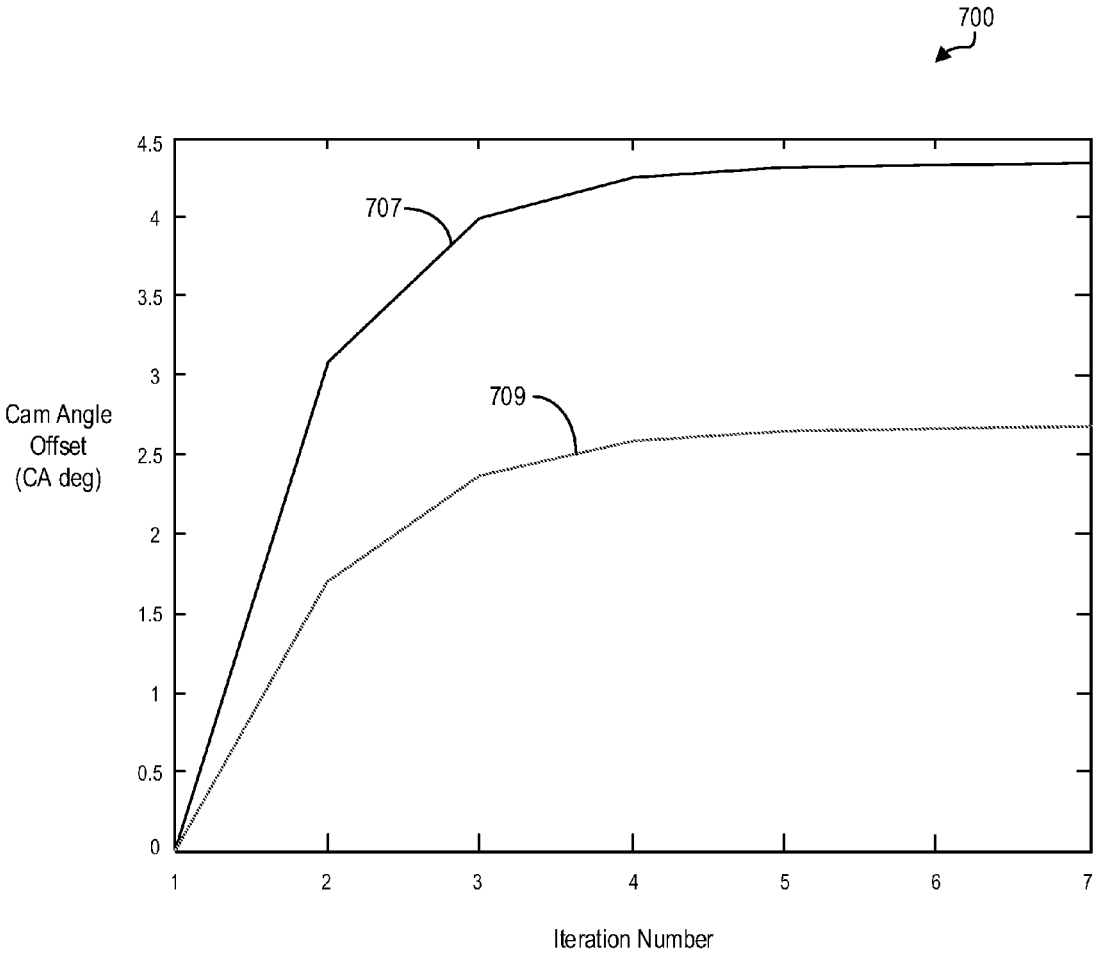
FIG. 7 shows example engine performance based on iterations of example vehicle data.

The present description relates to systems and methods for estimating cam timing errors in a motor vehicle. In particular, this description relates to improving volumetric efficiency calculations by correcting cam timing errors due to engine-to-engine build variation. A vehicle may be configured with a variable cam timing system to increase power and improve emissions of an engine, such as the example engine system depicted in FIG. 1. As shown by the control method depicted in FIG. 2, errors in the measured cam angle may be estimated using models of the air-fuel ratio entering the engine. Engine performance efficiency and improved emissions may be achieved by regarding other air and fuel control strategies when estimating cam angle errors, as shown in FIG. 3. Cam timing and adaptive fuel adaptations may also be performed in conjunction using the method shown in FIG. 4. A demonstration of how the disclosed systems and methods identify cam angle errors due to engine-to-engine build variation is shown in FIGS. 5-7.

Figure 1:
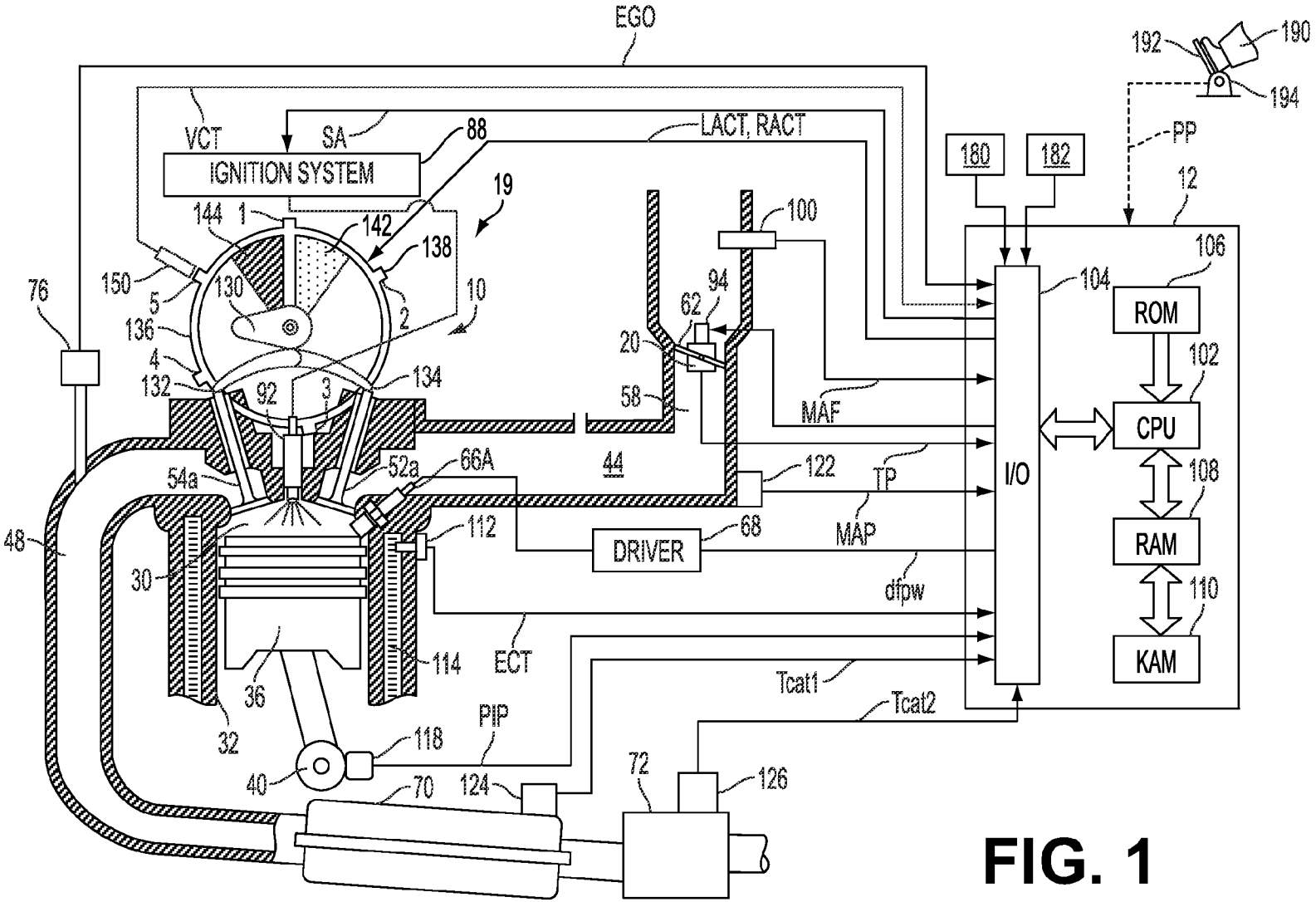
FIG. 1 shows a schematic depiction of an example engine.

FIG. 1 depicts an example embodiment of a combustion chamber or cylinder of internal combustion engine 10. FIG. 1 shows that engine 10 may receive control parameters from a control system including controller 12, as well as input from a vehicle operator 190 via an input device 192. In this example, input device 192 includes an accelerator pedal and a pedal position sensor 194 for generating a proportional pedal position signal PP.

Cylinder (herein also "combustion chamber") 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of the passenger vehicle via a transmission system (not shown). Further, a starter motor may be coupled to crankshaft 40 via a flywheel to enable a starting operation of engine 10. Crankshaft 40 is coupled to oil pump 208 to pressurize the engine oil lubrication system 200 (the coupling of crankshaft 40 to oil pump 208 is not shown). Housing 136 is hydraulically coupled to crankshaft 40 via a timing chain or belt (not shown).

Cylinder 30 can receive intake air via intake manifold or air passages 44. Intake air passage 44 can communicate with other cylinders of engine 10 in addition to cylinder 30. In some embodiments, one or more of the intake passages may include a boosting device such as a turbocharger or a supercharger. A throttle system including a throttle plate 62 may be provided along an intake passage of the engine for varying the flow rate and/or pressure of intake air provided to the engine cylinders. In this particular example, throttle plate 62 is coupled to electric motor 94 so that the position of elliptical throttle plate 62 is controlled by controller 12 via electric motor 94. This configuration may be referred to as electronic throttle control (ETC), which can also be utilized during idle speed control.

Combustion chamber 30 is shown communicating with intake manifold 44 and exhaust manifold 48 via respective intake valves 52*a* and 52*b* (not shown), and exhaust valves 54*a* and 54*b* (not shown). Thus, while four valves per cylinder may be used, in another example, a single intake and single exhaust valve per cylinder may also be used. In still another example, two intake valves and one exhaust valve per cylinder may be used.

Exhaust manifold 48 can receive exhaust gases from other cylinders of engine 10 in addition to cylinder 30. Exhaust gas sensor 76 is shown coupled to exhaust manifold 48 upstream of catalytic converter 70 (where sensor 76 can correspond to various different sensors). For example, sensor 76 may be any of many known sensors for providing an indication of exhaust gas air/fuel ratio such as a linear oxygen sensor, a UEGO, a two-state oxygen sensor, an EGO, a HEGO, or an HC or CO sensor. Emission control device 72 is shown positioned downstream of catalytic converter 70. Emission control device 72 may be a three-way catalyst, a NOx trap, various other emission control devices or combinations thereof.

In some embodiments, each cylinder of engine 10 may include a spark plug 92 for initiating combustion. Ignition system 88 can provide an ignition spark to combustion chamber 30 via spark plug 92 in response to spark advance signal SA from controller 12, under select operating modes. However, in some embodiments, spark plug 92 may be omitted, such as where engine 10 may initiate combustion by auto-ignition or by injection of fuel, as may be the case with some diesel engines.

In some embodiments, each cylinder of engine 10 may be configured with one or more fuel injectors for providing fuel thereto. As a non-limiting example, fuel injector 66A is shown coupled directly to cylinder 30 for injecting fuel directly therein in proportion to the pulse width of signal dfpw received from controller 12 via electronic driver 68. In this manner, fuel injector 66A provides what is known as direct injection (hereafter also referred to as "DI") of fuel into cylinder 30.

Controller 12 is shown as a microcomputer, including microprocessor unit 102, input/output ports 104, an electronic storage medium for executable programs and calibration values shown as read only memory chip 106 in this particular example, random access memory 108, keep alive memory 110, and a conventional data bus. Controller 12 is shown receiving various signals from sensors coupled to engine 10, in addition to those signals previously discussed, including measurement of inducted mass air flow (MAF) from mass air flow sensor 100 coupled to throttle 20; engine coolant temperature (ECT) from temperature sensor 112 coupled to cooling sleeve 114; a profile ignition pickup signal (PIP) from Hall effect sensor 118 coupled to crankshaft 40; a throttle position TP from throttle position sensor 20; absolute manifold pressure signal (MAP) from sensor 122; an indication of knock from knock sensor 182; and an indication of absolute or relative ambient humidity from sensor 180. Engine speed signal RPM is generated by controller 12 from signal PIP in a conventional manner and manifold pressure signal MAP from a manifold pressure sensor provides an indication of vacuum, or pressure, in the intake manifold. During stoichiometric operation, this sensor can give an indication of engine load. Further, this sensor, along with engine speed, can provide an estimate of charge (including air) inducted into the cylinder. In one example, sensor 118, which is also used as an engine speed sensor, produces a predetermined number of equally spaced pulses every revolution of the crankshaft.

Controller 12 may further include volumetric efficiency characterization, calibrated off-line at specific engine conditions and stored, for example, in lookup tables on read only memory chip 106, to perform on-line computations for functions that require such information. For example, controller 12 may use volumetric efficiency information and intake manifold pressure measurements to compute engine air flow. Further, controller 12 may use engine air flow computations to compute estimated intake manifold pressure.

Continuing with FIG. 1, a variable camshaft timing (VCT) system 19 is shown. In this example, an overhead cam system is illustrated, although other approaches may be used. Specifically, camshaft 130 of engine 10 is shown communicating with rocker arms 132 and 134 for actuating intake valves 52*a*, 52*b*, and exhaust valves 54*a*, 54*b*. VCT system 19 may be oil-pressure actuated (OPA), cam-torque actuated (CTA), or a combination thereof. By adjusting a plurality of hydraulic valves to thereby direct a hydraulic fluid, such as engine oil, into the cavity (such as an advance chamber or a retard chamber) of a camshaft phaser, valve timing may be changed, that is, advanced or retarded. As further elaborated herein, the operation of the hydraulic control valves may be controlled by respective control solenoids. Specifically, an engine controller may transmit a signal to the solenoids to move a valve spool that regulates the flow of oil through the phaser cavity. In one example, the solenoid may be an electrically actuated solenoid. As used herein, advance and retard of cam timing refer to relative cam timings, in that a fully advanced position may still provide a retarded intake valve opening with regard to top dead center, as just an example.

Camshaft 130 is hydraulically coupled to housing 136. Housing 136 forms a toothed wheel having a plurality of teeth 138. Housing 136 is mechanically coupled to crankshaft 40 via a timing chain or belt (not shown). Therefore, housing 136 and camshaft 130 rotate at a speed substantially equivalent to the crankshaft. However, by manipulation of the hydraulic coupling as described herein, the relative position of camshaft 130 to crankshaft 40 can be varied by hydraulic pressures in retard chamber 142 and advance chamber 144. By allowing high pressure hydraulic fluid to enter retard chamber 142, the relative relationship between camshaft 130 and crankshaft 40 is retarded. Thus, intake valves 52*a*, 52*b*, and exhaust valves 54*a*, 54*b* open and close at a time earlier than normal relative to crankshaft 40. Similarly, by allowing high pressure hydraulic fluid to enter advance chamber 144, the relative relationship between camshaft 130 and crankshaft 40 is advanced. Thus, intake valves 52*a*, 52*b*, and exhaust valves 54*a*, 54*b* open and close at a time later than normal relative to crankshaft 40.

While this example shows a system in which the intake and exhaust valve timing are controlled concurrently, variable intake cam timing, variable exhaust cam timing, dual independent variable cam timing, dual equal variable cam timing, or other variable cam timing may be used. Further, variable valve lift may also be used. Further, camshaft profile switching may be used to provide different cam profiles under different operating conditions. Further still, the valvetrain may be roller finger follower, direct acting mechanical bucket, electrohydraulic, or other alternatives to rocker arms.

Continuing with the variable valve timing system, teeth 138, being coupled to housing 136 and camshaft 130, allow for measurement of relative cam position via cam timing sensor 150 providing signal VCT to controller 12. Teeth 1, 2, 3, and 4 may be used for measurement of cam timing and are equally spaced (for example, in a V-8 dual bank engine, spaced 90 degrees apart from one another) while tooth 5 may be used for cylinder identification. In addition, controller 12 sends control signals (LACT, RACT) to conventional solenoid valves (not shown) to control the flow of hydraulic fluid either into retard chamber 142, advance chamber 144, or neither.

Relative cam timing can be measured in a variety of ways. In general terms, the time, or rotation angle, between the rising edge of the PIP signal and receiving a signal from one of the plurality of teeth 138 on housing 136 gives a measure of the relative cam timing. For the particular example of a V-8 engine, with two cylinder banks and a five-toothed wheel, a measure of cam timing for a particular bank is received four times per revolution, with the extra signal used for cylinder identification.

As described above, FIG. 1 merely shows one cylinder of a multi-cylinder engine, and that each cylinder has its own set of intake/exhaust valves, fuel injectors, spark plugs, etc.

Figure 2:
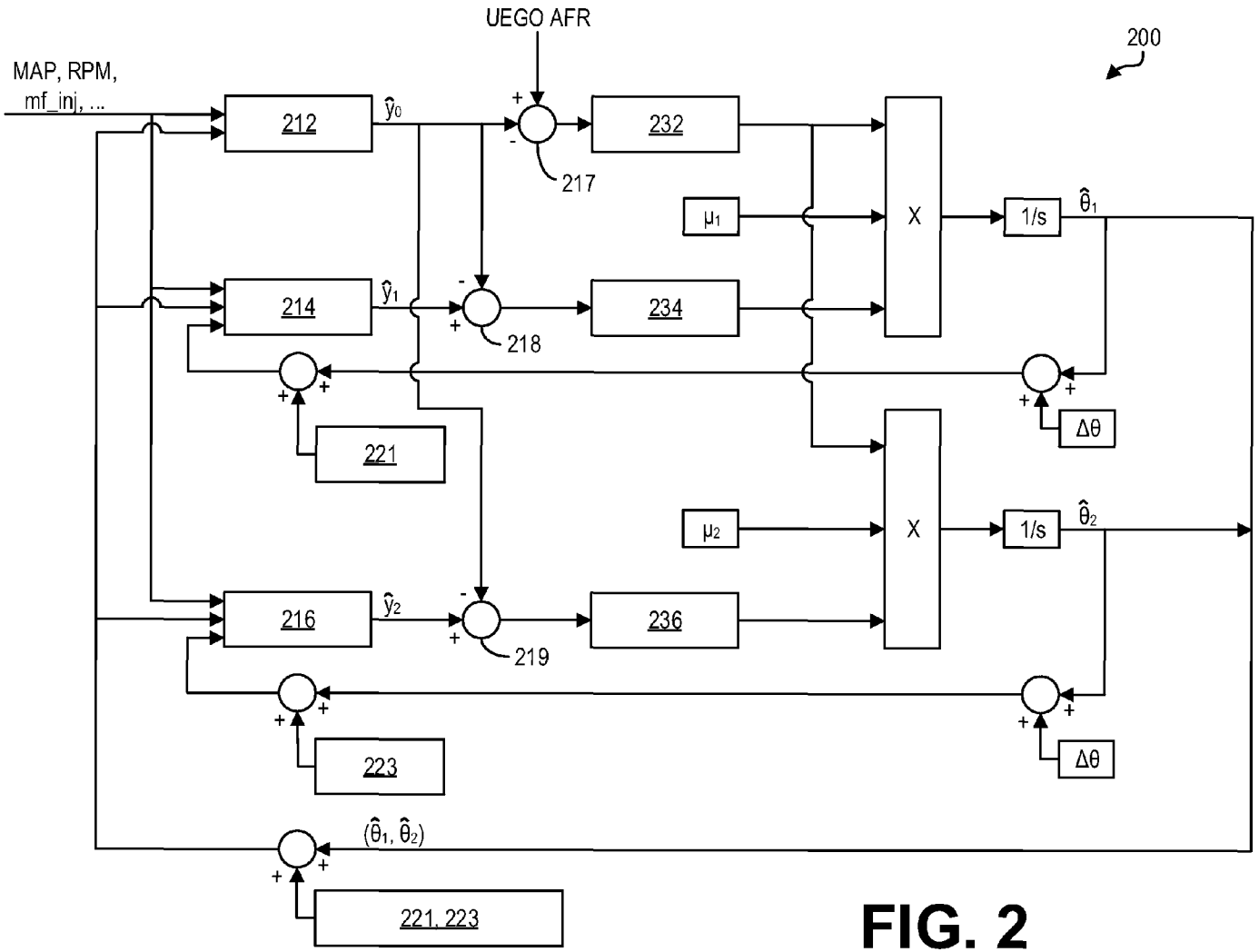
FIG. 2 shows an example control system block diagram.
Figure 3:
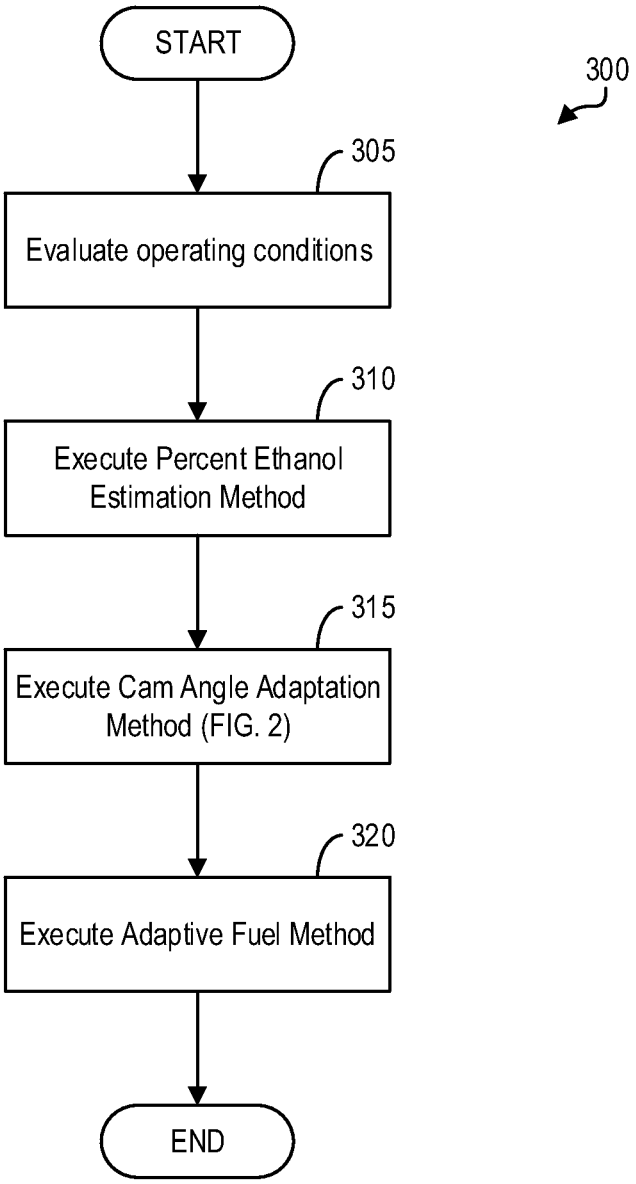
FIG. 3 shows a high-level flow chart illustrating an example method for adapting a cam angle with regard to other air and fuel adaptation methods.

FIG. 2 depicts a block diagram 200 illustrating a method for cam timing error estimation using air charge sensitivity. Block diagram 200 may be implemented by an engine controller, such as controller 12. Note that the example diagram 200 is shown for two cam angles and includes three models of the air-fuel ratio entering the engine, however in general (n+1) models may be required for adapting n angles. For example, a diagram for one cam angle may include two models.

As shown in FIG. 2, operating parameters including the fuel injection amount, MAP, RPM, and others are each passed to each of a first, second, and third steady-state exhaust AFR models respectively depicted at 212, 214, and 216. Each AFR model 212, 214, and 216 may be based on an estimate of air charge and fuel flowing through the engine:

$$\hat{y}_i = \frac{\text{air_chg_total}_i}{(mf_{inj} + mf_{other})},$$

where $\hat{y}_i$ is the steady-state exhaust air-fuel ratio, air_chg_total$_i$ is the total air charge estimate, $mf_{inj}$ is the injected fuel mass, $mf_{other}$ is any other fuel entering the cylinder besides from the fuel injectors, and i denotes the particular model. For example, $mf_{other}$ may model fuel in canister purge vapor and positive crankcase ventilation (PCV) vapor. In relatively steady-state and warm engine conditions, there should be no net fuel condensed into or evaporated from fuel puddles that may exist. To reduce modeling errors, the analysis may be limited to operation that excludes purge vapor combustion and further excludes conditions where the PCV flow estimate is above some threshold such that $mf_{other}$ is negligible. In the example shown, i=0 corresponds to the current engine conditions, while i=1 and i=2 respectively correspond to a modified intake cam angle position and a modified exhaust cam angle position. It is possible to estimate the steady-state exhaust AFR that would result if the cam angles were at different positions, because the typical engine mapping process includes characterization of the engine volumetric efficiency at different cam angle settings and engine speeds.

Returning to FIG. 2, the current AFR model $\hat{y}_0$ is passed to three junctions 217, 218, and 219. Junction 217 generates an AFR error $(y-\hat{y}_0)$ by computing the difference between the current AFR y measured by UEGO sensor 76 and current estimated AFR $\hat{y}_0$, and this error is then passed to low-pass filter 232. Meanwhile, junctions 218 and 219 generate derivative terms by computing the difference between the modified AFR estimates and the current AFR model $\hat{y}_0$ such that the derivative terms $(\hat{y}-\hat{y}_0)$ and $(\hat{y}_2-\hat{y}_0)$ are respectively passed to low-pass filters 234 and 236. Passing the error and derivative terms through low-pass filters 232, 234, and 236 rejects high-frequency transient impacts on the measured AFR.

The filtered AFR error is then multiplied separately with each derivative term and a corresponding adaptation gain μ. The multiplied terms are then each passed through an integrator 1/s to form estimated cam angle measurement corrections $\hat{\theta}_1$ and $\hat{\theta}_2$, which combine to form an estimated cam angle measurement correction vector $\vec{\hat{\theta}}=(\hat{\theta}_1, \hat{\theta}_2)$. In this example, the estimated cam angle measurement correction vector is a vector of two elements for an engine with two cam phasers. Similarly, in other examples the number of elements in the correction vector may equal the number of devices being adaptively corrected.

Each estimated cam angle measurement correction is passed through a summing junction, where a small perturbation Δθ is added to the correction $\hat{\theta}_i$. These perturbed cam angle corrections are then added to the corresponding estimated cam angles 221 and 223, and these corrected cam angle estimations are respectively input to AFR models 214 and 216. Further, the estimated cam angle measurement correction vector $(\hat{\theta}_1, \hat{\theta}_2)$ is added to cam angle vector (221, 223) from cam angle sensors, and this corrected cam angle vector is input to each AFR model 212, 214, and 216.

In this way, a gradient descent method may be implemented to adaptively estimate the cam angle corrections required to reduce the AFR error between the measured and estimated values. That is, block diagram 200 approximates the derivative of the modeled AFR with respect to the correction vector $\vec{\hat{\theta}}$ by the stochastic estimates:

$$\frac{\partial \hat{y}_1(\hat{\theta}_1)}{\partial \hat{\theta}_1} \cong \frac{(\hat{y}_1 - \hat{y}_0)}{\Delta\theta}, \quad \frac{\partial \hat{y}_2(\hat{\theta}_2)}{\partial \hat{\theta}_2} \cong \frac{(\hat{y}_2 - \hat{y}_0)}{\Delta\theta},$$

where $\hat{y}_0$ is the estimated exhaust AFR at $\vec{\hat{\theta}}$, $\hat{y}_1$ is the estimate of y at some small perturbation Δθ away from $\hat{\theta}_1$ or $((\hat{\theta}_1+\Delta\theta), \hat{\theta}_2)$, and $\hat{y}_2$ is the estimate of y at some small perturbation $\Delta\theta$ away from $\hat{\theta}_2$ or ($\hat{\theta}_1$, ($\hat{\theta}_2+\Delta\theta$)). Using the negative gradient of AFR error to cam angle correction as the locally optimal direction in which to change $\vec{\theta}$ to reduce the AFR error, and passing the error and derivative terms through low-pass filters as described above herein, gives the following parameter update rule embodied by block diagram 200:

$$\hat{\theta}_i(k+1) = \hat{\theta}_i(k) + \mu_i G_{lpf}(s)(y - \hat{y}_0)\left[\frac{G_{lpf}(s)(\hat{y}_i - \hat{y}_0)}{\Delta\theta}\right],$$

where k is the time step and $G_{lpf}$ (s) is the low-pass filter term.

As mentioned herein above, for the adaptation of two cam angles, block diagram 200 includes three AFR models: one for the AFR at the current estimate, and one for each AFR for the perturbed cam angle. Similarly, for the adaptation of only one cam angle, the appropriate block diagram may include two AFR models. In general, for the adaptation of n cam angles, a block diagram embodying the parameter update rule described herein above may include (n+1) volumetric-efficiency/air-fuel ratio models.

In this example, block diagram 200 generates the estimated cam angle measurement correction. However, the measured steady-state air-fuel ratio will be affected by parameters other than cam angle, for example the estimate of percent ethanol in the fuel, and any other learned adaptations due to errors in the fuel injector or air charge estimation characterizations in the engine control strategy, generally referred to as adaptive fuel. Hence a cam angle adaptation control strategy may function with regard to other control strategies.

In one example, a control strategy may isolate the estimation of fuel percent ethanol from other impacts on measured steady-state AFR. The percent ethanol may have a large impact on the stoichiometric AFR, and so the cam angle adaptation may be performed after the percent ethanol estimate has converged. A converged percent ethanol estimate refers to the percent ethanol estimate converging to a value within a tolerance band and remaining within this tolerance band for a specified period of time. In this way, the cam angle adaptation accuracy may be improved.

In another example, adaptive fuel control strategies rely on best estimates of injected fuel and engine air charge, and the cam angle errors that affect air charge estimation accuracy are primarily due to engine-to-engine build variation rather than other factors. Therefore, the cam angle adaptation may be performed before any adaptive fuel correction is learned. In this way, the adaptive fuel accuracy may be improved. A method for performing cam angle adaptation after the percent ethanol estimate has converged and before any adaptive fuel methods are performed is described further herein and with regard to FIG. 3.

In another example, cam angle and adaptive fuel adaptations may have distinct sensitivities over the engine operating space, thereby enabling simultaneous adaptation. For example, the exhaust cam angle error may impact AFR more at retarded values, or later exhaust valve events, than for base exhaust cam timing, while an injector slope error may impact AFR similarly for all cam angles.

The sensitivity of AFR to cam angle error is different for different cam angles, and so in one example, cam angle adaptations may be limited to regions of higher sensitivities. In this way, cam angle adaptations may quickly adapt with increased accuracy.

In another example, unique estimates of cam angle error may be obtained in different regions, for example, high retard corresponds to higher sensitivity and low retard corresponds to lower sensitivity. These unique estimates may be combined to form a composite estimate of cam angle error. For example, at base exhaust cam timing (zero retard), the sensitivity of AFR to exhaust cam error is low. An AFR error that is partially due to a cam timing error may learn a large cam timing correction (that is, low sensitivity may require a large correction to fix). At retarded exhaust cam timing, the sensitivity of AFR to exhaust cam error is high. An AFR error that is partially due to an exhaust cam timing error may therefore learn a small exhaust cam timing correction (that is, high sensitivity may require a small correction to fix). Therefore, as the engine moves between these two conditions, the adaptive algorithm may adjust the exhaust cam timing error estimate between large and small values. If the AFR error were only due to exhaust cam timing errors, then the adaptive algorithm may quickly converge.

Thus, the cam timing adaptation may be performed only during the region of higher cam sensitivities. For example, cam angle adaptations may be performed when the exhaust cam angle is greater than a threshold for adapting the exhaust cam timing error and when the intake cam angle is greater than a threshold for adapting the intake cam timing error. Then an adaptive fuel adaptation may be performed only during regions of lower cam sensitivities, for example, when the exhaust cam angle is less than the exhaust cam angle threshold and the intake cam angle is less than the intake cam angle threshold. A method for performing cam timing adaptations only during regions of high sensitivities is described further herein and with regard to FIG. 4.

In another example, the cam angle adaptation may be performed initially with a relatively high gain, and once the adaptation converges, the adaptation may be performed with a relatively low gain. In this way, the cam angle adaptation method may generate a more accurate correction for vehicle-to-vehicle build errors that do not change significantly over time.

A cam angle adaptation method may further include on-line validation. If there is a correlation between the AFR estimation error and cam angle errors, then adaptation of $\vec{\theta}$ should improve the air charge estimation accuracy and decrease the AFR estimation error. However, if the AFR estimation error and cam angle errors are relatively uncorrelated, then $\vec{\theta}$ may significantly vary over time, and therefore not converge to some set of values that improves the air charge estimation accuracy. To that end, after completion of initial adaptation, defined as $\vec{\theta}$ remaining within a pre-determined tolerance band of a specific moving average value for a specified time, if $\vec{\theta}$ remains within some larger tolerance band around that value, then correlation may be inferred and $\vec{\theta}$ may be used to correct the estimated air charge. However, if $\vec{\theta}$ does not complete the initial adaptation, or varies outside of the larger tolerance band after initial adaptation, then the opposite is true and for this specific vehicle, $\vec{\theta}$ should not be used to correct the air charge estimation.

FIG. 3 shows a high-level flow chart for an example method 300 for performing cam angle adaptations with regard to other adaptation control methods in accordance with the current disclosure. Method 300 will be described herein and with reference to the components and systems depicted in FIGS. 1 and 2, though it should be understood that the method may be applied to other systems without departing from the scope of this disclosure. Method 300 may be carried out by controller 12, and may be stored as executable instructions in non-transitory memory.

Method 300 may begin at 305. At 305, method 300 may include evaluating operating conditions. Operating conditions may include, but are not limited to, injected fuel mass, fuel mass in canister purge vapor and PCV vapor, exhaust air-fuel ratio, cylinder air amount, intake cam angle, exhaust cam angle, engine speed, engine load, engine coolant temperature, engine temperature, feedback from a knock sensor, manifold pressure, equivalence ratio, desired engine output torque from pedal position, spark timing, barometric pressure, fuel vapor purging amounts, and the like. Method 300 may then continue to 310.

At 310, method 300 may include executing a percent ethanol estimation method. An example percent ethanol estimation method may adjust fuel injection based on a fuel make-up, such as fuel ethanol content. The fuel make-up may be learned by correlating transient fueling effects caused by the different evaporation rates of higher and lower ethanol content to measured exhaust air-fuel ratio. The percent ethanol may have a large impact on the stoichiometric air-fuel ratio, and so method 300 may not proceed until the percent ethanol estimate converges. Once the percent ethanol estimate converges, the fuel injection may be adjusted responsive to the percent ethanol estimate. Method 300 may then continue to 315.

At 315, method 300 may include executing a cam angle adaptation method, such as the method embodied by block diagram 200 shown in FIG. 2. Adaptation of the estimated cam angle measurement correction vector may improve the air charge estimation accuracy and decrease the air-fuel ratio estimation error. Method 300 may then continue to 320.

At 320, method 300 may include executing an adaptive fuel method. An example adaptive fuel method may include feedback loops for controlling an air-fuel ratio entering an engine. For example, one feedback loop around the engine may control an oxygen concentration in the exhaust gas while another feedback loop may adjust the air-fuel ratio entering the engine. Adaptive fuel methods are well understood in the art and therefore will not be described further.

Since such a fuel and air charge adaptation method relies on the best estimates of injected fuel and engine air charge, an adaptive fuel method may not execute until the percent ethanol estimation method and the cam angle adaptation method are complete. However, under particular conditions, cam angle and adaptive fuel adaptations may simultaneously execute. For example, the exhaust cam angle error may impact the air-fuel ratio more at retarded values than for base exhaust cam timing, but an injector slope error will impact air-fuel ratio similarly for all cam angles. Performing adaptive fuel and cam angle adaptations is discussed further herein and with regard to FIG. 4. Once the adaptive fuel adaptation is complete, method 300 may end.

Figure 4:
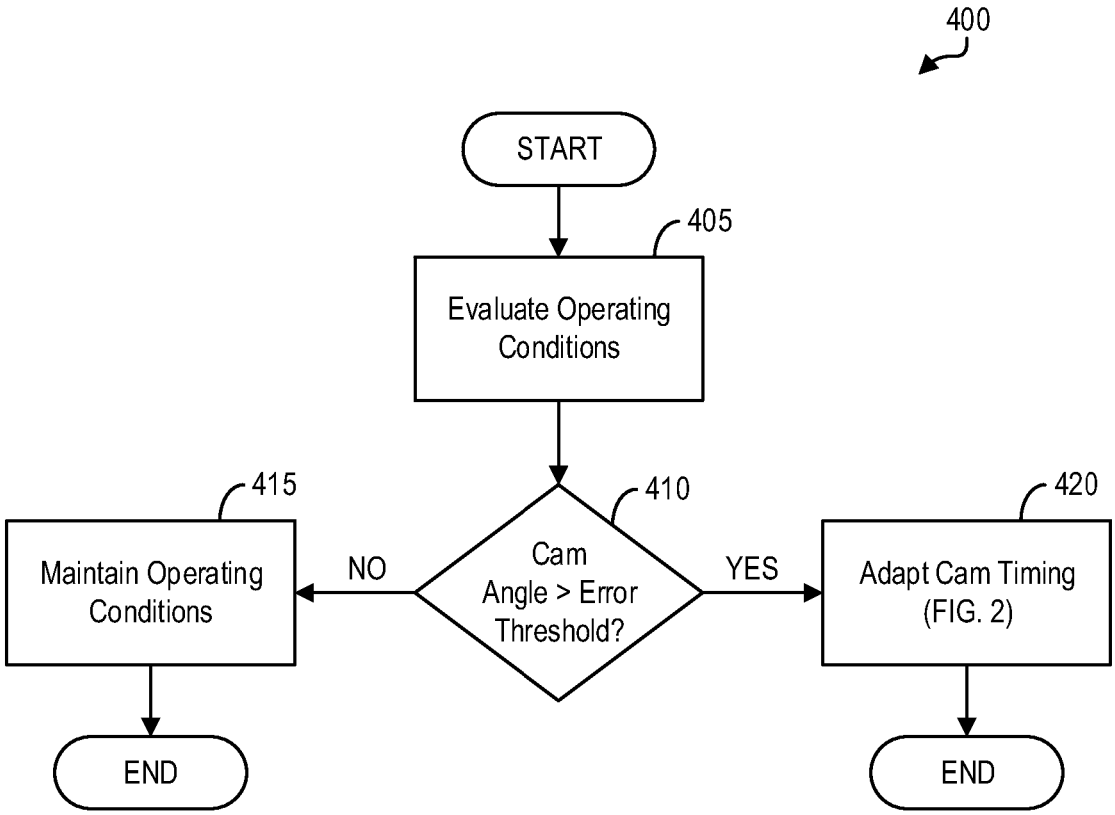
FIG. 4 shows a high-level flow chart illustrating an example method for adapting a cam angle.

FIG. 4 shows an example method 400 for adapting cam angle timing errors during selected conditions. Method 400 comprises learning cam angle corrections to update a measured cam angle responsive to air-fuel ratio errors during selected conditions, and learning air and fueling errors responsive to the air-fuel ratio error otherwise. In the example shown, the selected conditions comprise a measured cam angle above a threshold. Hence method 400 demonstrates that cam timing adaptation may only be performed during the region of higher cam sensitivities, while the existing adaptive fuel adaptation may be performed only during regions of lower cam sensitivities. Method 400 will be described herein with reference to the components and systems depicted in FIGS. 1 and 2, though it should be understood that method 400 may be applied to other systems without departing from the scope of this disclosure. Method 400 may be carried out by controller 12, and may be stored as executable instructions in non-transitory memory.

At 405, method 400 may include evaluating operating conditions. Operating conditions may include, but are not limited to, injected fuel mass, fuel mass in canister purge vapor and positive crankcase ventilation (PCV) vapor, combustion air-fuel ratio, air charge, manifold pressure, intake cam angle, exhaust cam angle, percent ethanol in injected fuel, engine speed, engine load, and the like. Method 400 may then continue to 410.

At 410, method 400 may include determining if the cam angle is greater than a cam angle error threshold, where the cam angle may include an exhaust cam angle and/or an intake cam angle. For example, at base exhaust cam timing, or zero retard, the sensitivity of AFR to exhaust cam error is low, so that an AFR error that is partially due to an exhaust cam timing error may learn a large exhaust cam angle correction. Similarly, at base intake cam timing, or zero retard, the sensitivity of AFR to intake cam error is low, so that an AFR error that is partially due to an intake cam timing error may learn a large intake cam angle correction. At retarded exhaust or intake cam timing, the sensitivity of AFR to exhaust or intake cam errors is high. An AFR error that is partially due to an exhaust or intake cam timing error may learn a small exhaust or intake cam angle correction, since high sensitivity would require a small cam angle correction to fix. Hence, the region above a cam angle error threshold may correspond to a retarded exhaust or intake cam angle, while the region below a cam angle error threshold may correspond to a base exhaust or intake cam angle.

If the cam angle is less than a cam angle error threshold, method 400 may then continue to 415. At 415, method 400 may include maintaining operating conditions. Maintaining operating conditions may comprise learning air and fueling errors responsive to an air-fuel ratio error. For example, maintaining operating conditions may include performing an adaptive fuel method. An example adaptive fuel method may adjust the AFR entering the engine responsive to a measured exhaust AFR and/or an oxygen concentration of the exhaust gas. Method 400 may then end.

Returning to 410, if the cam angle is greater than a cam angle error threshold, method 400 may proceed to 420. At 420, method 400 may include adapting the cam timing. As discussed herein with regard to FIG. 2, adapting the cam timing may include learning a cam angle correction to reduce an AFR error. Method 400 may then end.

FIG. 5 shows example vehicle data 500 that may be used to determine exhaust cam angle offset present in a vehicle. In particular, plot 511 shows a normalized engine load as a function of time, plot 521 shows an engine speed as a function of time, plot 531 shows an exhaust cam angle as a function of time, and plot 533 shows an intake cam angle as a function of time. Plot 531 shows that the exhaust cam angle primarily moves between two values, 45 degrees and 0 degrees, with rapid changes between these two positions.

FIG. 6 shows a graph 600 illustrating a simulation of exhaust cam angle offset learning for one pass through vehicle data 500. Plot 611 shows the learned exhaust cam angle offset for the advanced position, corresponding to the exhaust cam angle position of 0 degrees in plot 531. Plot 617 shows the learned exhaust cam angle offset for the retarded position, corresponding to the exhaust cam angle position of 45 degrees in plot 531. Thus two values are learned: one for fully retarded position, and one for fully advanced position. The initial condition of the learned exhaust cam angle offset was zero. The gains are conservatively calibrated, so that during the five minute duration of the sample vehicle data 500, the learning does not converge.

To simulate a longer file which may allow the algorithm to converge, the data was iterated multiple times, using the last learned value as the starting value for the next pass. FIG. 7 shows a graph 700 illustrating the results of such a simulation. Vehicle data 500 was input to the control system 200, and iterated until the estimated exhaust cam angle offset was changing less than a specified amount (0.01 CA degrees). Plot 707 shows the low cam angle offset corresponding to the cam angle learned in regions of low sensitivity (in particular, for a cam angle below 7 crank degrees). Plot 709 shows the high cam angle offset corresponding to the cam angle learned in regions of high sensitivity (in particular, for a cam angle above 35 crank degrees).

As discussed herein above, an AFR error that is partially due to an exhaust cam timing error may learn a small exhaust cam angle correction in regions of high sensitivity, and a large exhaust cam angle correction in regions of low sensitivity. Indeed, plot 707 shows that the low-sensitivity cam angle correction converges to 4.3 degrees, while plot 709 shows that the high-sensitivity cam angle correction converges to 2.7 degrees. A composite offset may be determined by averaging the two converged values. For the example of graph 700, such a composite offset would be 3.5 crank degrees.

As one embodiment, a method comprises learning cam angle corrections to update a measured cam angle responsive to air-fuel ratio errors during selected conditions, and learning air and fueling errors responsive to the air-fuel ratio error otherwise. In one example, the selected conditions include a measured cam angle above a threshold. In another example, the selected conditions include a converged percent ethanol estimate. In another example, the selected conditions include a fuel injector slope error. In yet another example, the selected conditions include the cam angle corrections converging within a tolerance band for a specified amount of time. In another example, the selected conditions include the measured cam angle above a threshold and below the threshold, and wherein the cam angle corrections include a first correction learned above the threshold and a second correction learned below the threshold. In yet another example, the specified conditions include a fuel mass below a threshold, the fuel mass comprising canister purge vapor and positive crankcase ventilation vapor.

The cam angle corrections are learned from steady-state air-fuel ratio models based on air charge estimates. The cam angle corrections further include a composite value formed from the average of the first correction and the second correction. In one example, the measured cam angle is one or more exhaust cam angles. In another example, the measured cam angle is one or more intake cam angles. In another example, the measured cam angle is one or more exhaust cam angles and one or more intake cam angles.

As another embodiment, a method comprises generating a first air-fuel ratio estimate based on engine operating conditions, generating a second air-fuel ratio estimate based on modified engine operating conditions, generating a first error based on the first air-fuel ratio estimate and a measured air-fuel ratio, generating a second error based on the second air-fuel ratio estimate and the first air-fuel ratio estimate, generating a cam angle correction based on the first error and the second error, and updating a cam angle measurement based on the cam angle correction. In one example, the modified engine operating conditions include a modified cam angle measurement based on a perturbation of the cam angle measurement.

For example, generating the cam angle correction based on the first error and the second error comprises integrating a product of the first error and the second error. The first error and the second error are low-pass filtered with low-pass filters. In one example, the cam angle correction is generated with a high adaptation gain prior to a convergence of the cam angle correction and a low adaptation gain after the convergence of the cam angle correction.

In one example, the cam angle measurement is an exhaust cam angle measurement. In another example, the cam angle measurement is an intake cam angle measurement. In yet another example, the cam angle measurement comprises one or more exhaust cam angle measurements and one or more intake cam angle measurements.

As another embodiment, a system for controlling an engine comprises a controller configured with instructions stored in non-transitory memory, that when executed, cause the controller to learn cam angle corrections responsive to air-fuel ratio errors during selected conditions. In one example, the selected conditions include at least one of a converged percent ethanol estimate and a cam angle measurement above a threshold. The controller is further configured with instructions stored in non-transitory memory, that when executed, cause the controller to update a cam angle measurement based on the cam angle corrections responsive to the cam angle corrections remaining within a tolerance band for a specified amount of time.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

learning cam angle corrections based on at least two air charge estimates to update a measured cam angle responsive to an air-fuel ratio error during selected conditions, the air charge estimates estimated concurrently based on the air-fuel ratio error, the air-fuel ratio error based on a measured air-fuel ratio, one of the at least two air charge estimates based on a perturbed cam angle position, wherein the perturbed cam angle position is perturbed relative to a current cam angle position;

learning air and fueling errors responsive to the air-fuel ratio error otherwise; and adjusting an operating parameter of an engine based on the updated measured cam angle.

2. The method of claim 1, wherein the selected conditions include a measured cam angle above a threshold.

3. The method of claim 1, wherein the selected conditions include a converged percent ethanol estimate.

4. The method of claim 1, wherein the selected conditions include a fuel injector slope error.

5. The method of claim 1, wherein the selected conditions include the cam angle corrections converging within a tolerance band for a specified amount of time.

6. The method of claim 1, wherein the selected conditions include the measured cam angle above a threshold and below the threshold, and wherein the cam angle corrections include a first correction learned above the threshold and a second correction learned below the threshold.

7. The method of claim 6, wherein the cam angle corrections further include a composite value formed from an average of the first correction and the second correction.

8. The method of claim 1, wherein the measured cam angle is one or more exhaust cam angles.

9. The method of claim 1, wherein the measured cam angle is one or more intake cam angles.

10. The method of claim 1, wherein the selected conditions include a fuel mass below a threshold, the fuel mass comprising canister purge vapor and positive crankcase ventilation vapor.

11. The method of claim 1, wherein the cam angle corrections are learned from steady-state air-fuel ratio models.

12. A method, comprising:

generating a first air-fuel ratio estimate based on measured engine operating conditions;

generating a second air-fuel ratio estimate based on modified engine operating conditions, wherein the modified engine operating conditions are modified relative to the measured engine operating conditions;

generating a first error based on the first air-fuel ratio estimate and a measured air-fuel ratio;

generating a second error based on the second air-fuel ratio estimate and the first air-fuel ratio estimate;

generating a cam angle correction based on the first error and the second error;

updating a cam angle measurement based on the cam angle correction; and updating an operating parameter of an engine based on the updated cam angle measurement.

13. The method of claim of claim 12, wherein the modified engine operating conditions include a modified cam angle measurement based on a perturbation of the cam angle measurement.

14. The method of claim 12, wherein generating the cam angle correction based on the first error and the second error comprises integrating a product of the first error and the second error.

15. The method of claim 12, wherein the first error and the second error are low-pass filtered with low-pass filters.

16. The method of claim 12, wherein the cam angle correction is generated with a high adaptation gain prior to a convergence of the cam angle correction and a low adaptation gain after the convergence of the cam angle correction.

17. The method of claim 12, wherein the cam angle measurement comprises at least one exhaust cam angle measurement and at least one intake cam angle measurement.

18. A system for controlling an engine, comprising a controller configured with instructions stored in non-transitory memory, that when executed, cause the controller to learn cam angle corrections based on at least two air charge estimates responsive to air-fuel ratio errors during selected conditions, the at least two air charge estimates estimated concurrently, and update an operating parameter of the engine based on the cam angle corrections.

19. The system of claim 18, wherein the controller is further configured with instructions stored in non-transitory memory, that when executed, cause the controller to update a cam angle measurement based on the cam angle corrections responsive to the cam angle corrections remaining within a tolerance band for a specified amount of time.

20. The system of claim 18, wherein the selected conditions include at least one of a converged percent ethanol estimate and a cam angle measurement above a threshold.

* * * * *